United States Patent [19]

Wilson

[11] 4,205,473

[45] Jun. 3, 1980

[54] TELESCOPE MOUNT FOR FIREARMS

[76] Inventor: Hugh R. Wilson, 10840 SW. 120th St., Miami, Fla. 33176

[21] Appl. No.: 938,895

[22] Filed: Sep. 1, 1978

[51] Int. Cl.[2] ..... F41G 1/38

[52] U.S. Cl. ..... 42/1 ST; 33/250

[58] Field of Search ..... 42/1 ST; 33/250

[56] References Cited

U.S. PATENT DOCUMENTS

| | | | |
|---|---|---|---|
| 2,641,057 | 6/1953 | Moore | 33/250 |
| 2,810,963 | 10/1957 | Harper | 33/250 |
| 2,854,748 | 10/1958 | Williams | 42/1 ST |
| 3,276,127 | 10/1966 | Abrahamson | 42/1 ST |
| 3,877,166 | 4/1975 | Ward | 42/1 ST |
| 3,880,389 | 4/1975 | Burris | 42/1 ST |
| 4,085,511 | 4/1978 | Kovac | 42/1 ST |

*Primary Examiner*—Charles T. Jordan

[57] ABSTRACT

This invention is that of a new and novel telescope mount for firearms that features a rotating locking device mounted in the body of the telescope holding ring that mates with a base which is attached to the firearm. A lever is mounted on the locking member to provide leverage for locking. The rotating lock may be used toward both ends of the telescope or a single unit may be used when a hinged mount is used at the other end of the telescope. Lateral adjustment is provided in the base for windage adjustment. The telescope may be quickly installed on the firearm or removed therefrom without the use of tools or other implements, eliminates loose screws that may become lost or mis-laid and is silent in operation.

9 Claims, 10 Drawing Figures

TELESCOPE MOUNT FOR FIREARMS

FIELD OF THE INVENTION

The invention relates to hunting of game and for use with hunting rifles in particular. It may be also used with target rifles or military weapons.

DESCRIPTION OF THE PRIOR ART

Although many telescope mounts have appeared in the past, only the "Suhler" "claw mounts" produced in Germany have provided a mount that is instantly detachable from the firearm, instantly re-attachable, all without tools or loose parts, always returns to "zero" for accuracy and which lends beauty and symmetry to a fine rifle. Most of the other mounts require that the user must search for a screw driver or a large coin whith which to turn or remove screws in order to remove the telescope from the firearm. It is sometimes necessary to remove the telescope under such conditions as thick heavy grass or bushes or in failing light or when the lens of the telescope have been soiled with mud or some other matter. This is usually when the user discovers that he has neglected to bring along a screwdriver or that to avoid noise, he removed all coins from his pocket and now has no means to lossen the retaining screws to remove the telescope. If he has such things with him he finds that he must now remove his eyes from the game in order to see the screws on his telescope mount and may fail to follow the movement of the game animal and loose it as a result. This new and novel mount departs from the old art and provides a telescope that can be quickly removed from or installed on a firearm without tools and without the user taking his eyes from quarry and may be removed very silently, even in the dark.

The "Suhler claw mounts" referred to above are very expensive in that they must be hand fitted to each individual rifle if the optimum results are to be obtained. This invention allows the manufacturer to use standard machining methods and the user is able to install the mounts himself resulting in a very versatile mount at a very reasonable price. When the telescope is removed from the firearm, the remaining bases are complimentary to the firearm and the absence of protruding base structure presents a more symmetrical and graceful appearance to the firearm. The locking lugs and the matching cavities in the bases are known and have been in use for many years and are not novel. The mounting of the locking lug in the post of the telescope holding ring is one of the principal novelties of the invention, as locking is accomplished by rotation of the locking lug while the telescope and the holding ring remains stationary. This new invention also eliminates many of the causes of mis-alignment of the telescope as since the front mount is pivotally secured, and the front mount is also hinged for vertical movement of the rear of the telescope, a condition such as is found in a universal joint is present and with the pivotal locking of the rear mount included, many areas of mis-alignment are eliminated even when the lateral adjustment feature is utilized. Although the device is shown in the drawings as having a hinged front base, an unhinged base may be used and the rear locking lug may enter the rear base through an opening in the side of the base as shown in FIG. 10. The novelty and usefullness of this new invention will become more apparent in the detailed description that follows.

SUMMARY OF THE INVENTION

It is a principal object of this invention to provide a novel and improved telescope mount for firearms.

A second objective is to provide a new and novel telescope that is instantly removable from the firearm without the use or necessity of tools.

Another object is to provide a telescope mount that is more self aligning to eliminate stresses and internal tensions to the optical system of the telescope and resulting in better accuracy for the user of the firearm.

A further object of this invention is to provide the novel rotating locking member which is mounted in the body of the telescope holding ring.

A still further object of this invention is to provide a new locking system wherein the lateral adjustment is not disturbed when the telescope is removed from the firearm or when the telescope is re-installed on the firearm.

A still further object of this invention is to provide a new telescope mounting system that allows the telescope to be removed from the firearm or re-installed on the firearm in a vertical motion by using rotating locks at both ends of the telescope and eliminating a swinging motion and a vertical hinged movement for use of telescopes made with a very large objective lens.

Additional objects are to provide a new and novel telescope mount that is easy and simple to use, rugged, reliable and relatively inexpensive to manufacture.

A BRIEF DESCRIPTION OF THE DRAWINGS

DETAILED DESCRIPTION

Figure 1:
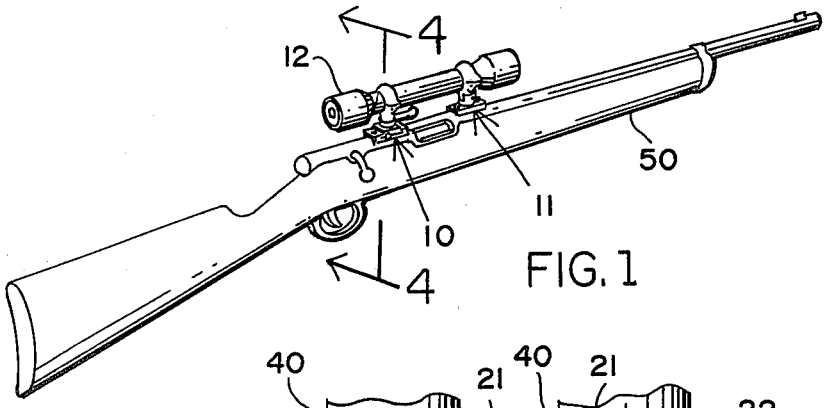
FIG. 1 shows a rifle with a telescope mounted thereon.
Figure 6:
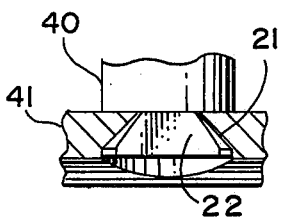
FIG. 6 is a cross section view showing a locking lug in a locked position in a base.
Figure 7:
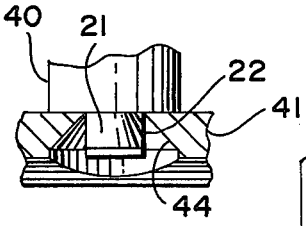
FIG. 7 is a sectional view showing a locking lug in an unlocked position in a base.
Figure 2:
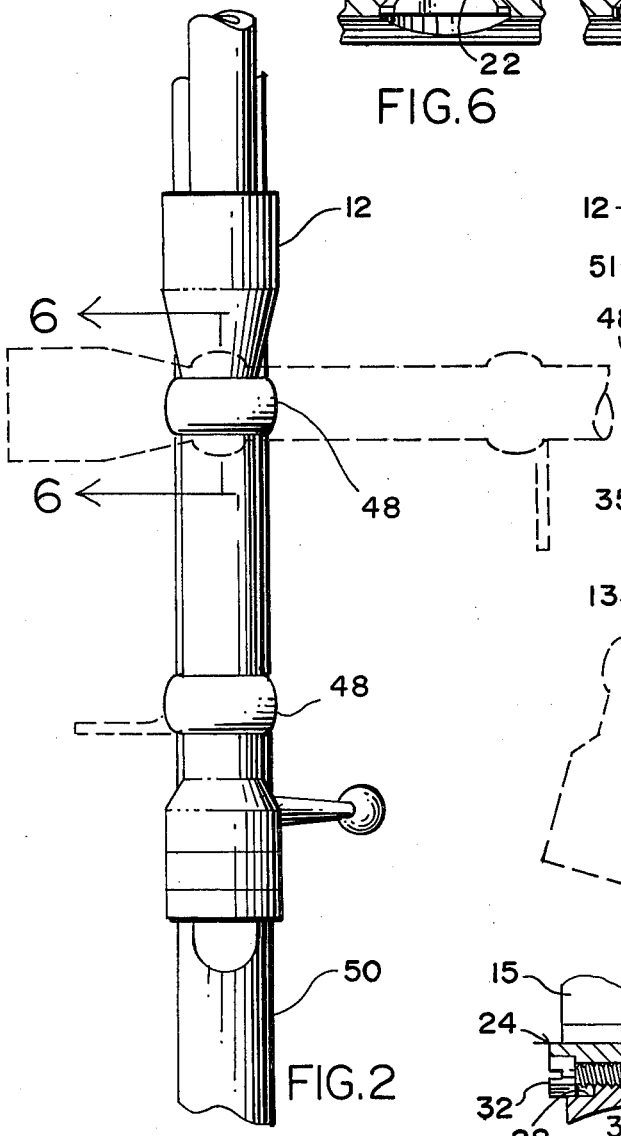
FIG. 2 is a top view of a telescope mounted on a rifle, in broken lines, showing that a telescope mount may be attached to the base at right angles, swinging to a locking position.
Figure 3:
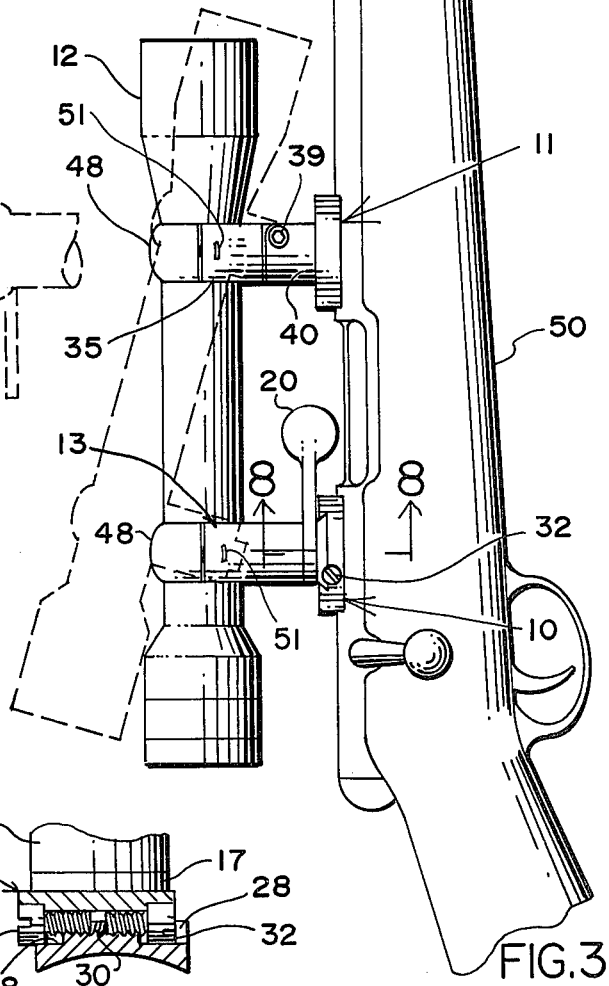
FIG. 3 shows a telescope mounted on a rifle and that a hinged front mount allows the telescope to swing vertically to connect with the rear mount, the movement of the telescope shown in broken lines.
Figure 8:
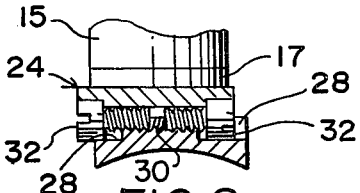
FIG. 8 is a cross sectional view showing construction of the windage adjustment system.
Figure 4:
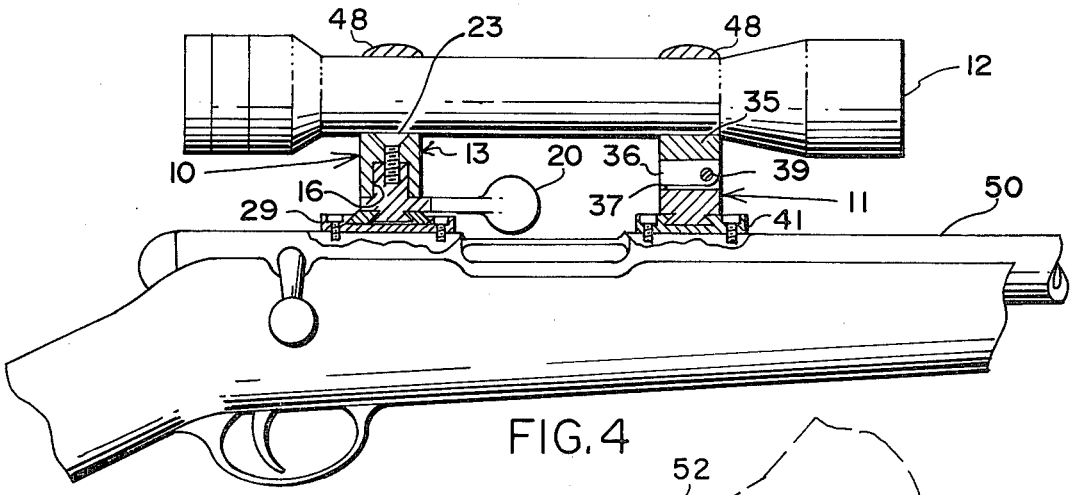
FIG. 4 is a sectional side view showing the construction of the mountings.
Figure 5:
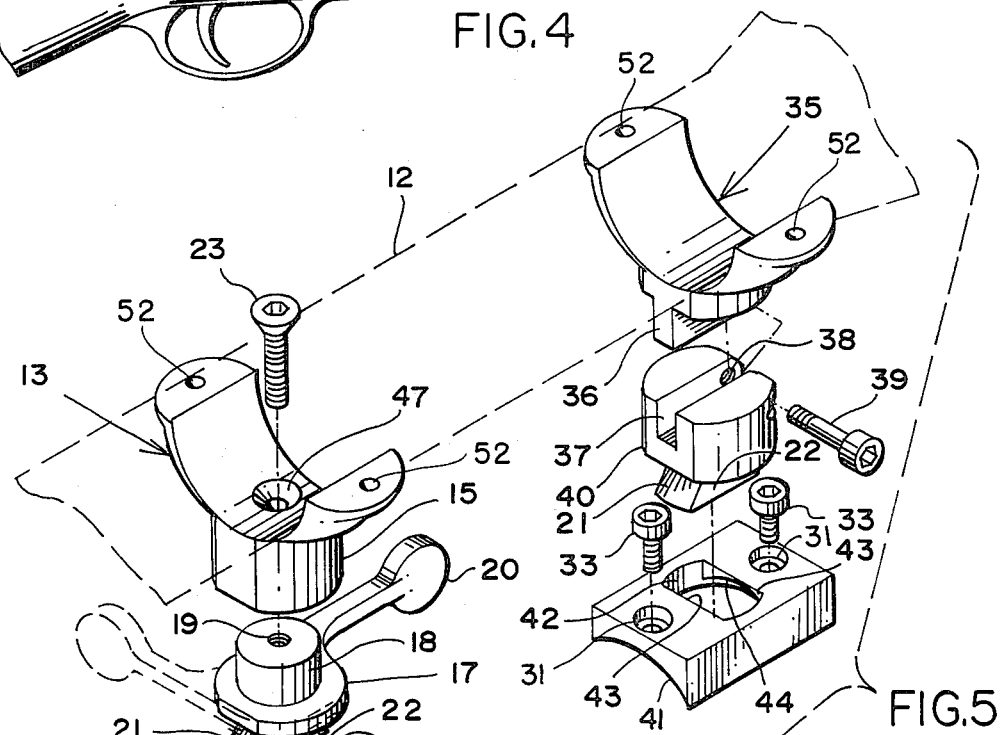
FIG. 5 is an exploded view showing the component parts of the mounts with the telescope body shown in broken lines.

Referring to the drawings by characters of reference, FIGS. 1–10 illustrate a rear telescope mount 10 and a front telescope mount 11.

The rear mount 10 comprising a lower half 13 and a top portion 48 which when held together by the screws 51 through the holes 52, clamp the body of the telescope 12 in a secured position. The ring 13 has a post portion 15 extending downward and the post 15 is provided with the cavity 16 which is cylindrical in shape and extends upwards from the bottom of the post 15. The cylindrical boss 18 on the rotating locking member 17 fits closely in the cavity 16 and is held by the screw 23 which extends downward through the hole 47 and into the threaded hole 19 in the boss 18. This permits the boss 18 to rotate in the cavity 16 while the telescope 12 and the ring 13 remain in a stationary position. The rotating locking member 17 is provided with the lug 21 and the lug 21 has the flat sides 22 to permit entry into the dove-tailed base plate 24 through the slot 25. The underside of the base plate 24 has a cavity that matches the shape of the lug 21. This mating cavity 44 is engaged by the lock lug 21 when the rotating locking member 17 is rotated to a locking position. The hand lever 20 is to provide leverage for rotating the device to a locking position, and for returning it to an unlocked position. The dovetailed base plate 24 fits into the dovetail slot 34 of the mount base 29 and may be moved to the right or left by use of the adjusting screws 32 which engage the counterbores 27 of the dovetailed base plate 24 and the threaded bore 30 in the mount base 29. The counterbores 28 are of excessive depth to allow movement of the dovetailed base plate 24 in the slot 34. The mount base 29 is to be attached to a firearm by the two screws 33 through the holes 31 in the mount base 29.

Figure 9:
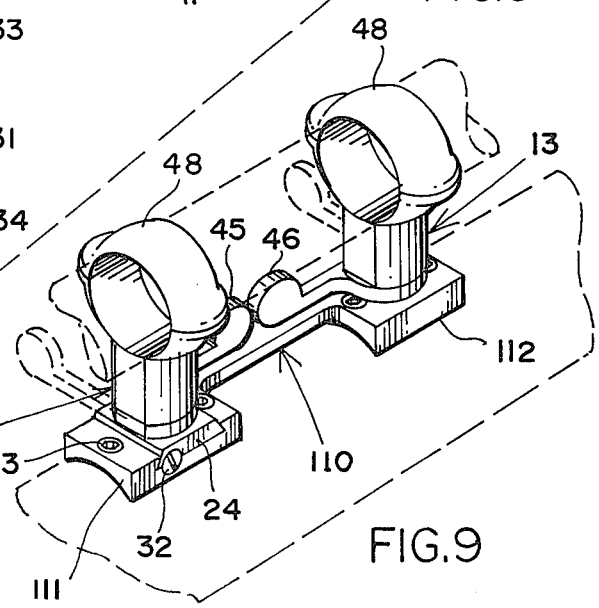
FIG. 9 is a top view showing a one piece base with two lever operated rings mounted thereon allowing vertical insertion of the locking lugs into the base.

Although the above described mount was referred to as a rear mount it is not confined to that use only. FIG. 9 shows that the mount may be used in pairs, one serving as a front mount, the other as a rear mount. FIG. 9 illustrates the use of a one piece base mount 110 with two of the devices attached thereto for holding a telescope in position. The dovetailed base plate 24 is mounted in the rear portion of the base mount 110, the rear portion shown as 111, a second device is mounted on the front part 112. On the rear mount the lever 45 swings forward for locking and the lever on the front mount swings to the rear for locking. This arrangement allows both front and rear locking lugs to be introduced into the mount base at the same time while the telescope is held paralell to the barrel of the firearm.

Figure 10:
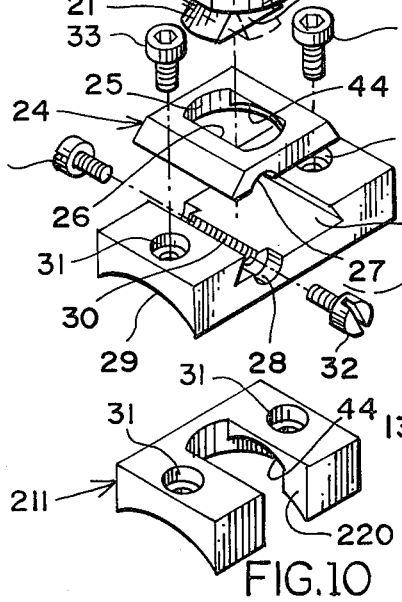
FIG. 10 shows an alternate type of base with a side opening so that a locking lug may be introduced into the base from the side.

Although the drawings show that the front mount is of a hinged construction the previously described device can also be used with a non-hinged front mount by use of the base mount shown in FIG. 10 which has an opening in the side which allows the locking lug to enter the base from the side and then be rotated to a locked position. Although no provision has been shown for lateral adjustment in the mount base illustrated in FIG. 10 it can be included if so desired. The mount base 211 is attached to a firearm 50 by the method of two screws through the holes 31 in the mount base 211. The locking lug 21 enters the opening 220 and is rotated into locking engagement with the cavity 44 as previously described.

The front mount 11 has an upper portion 35 which when attached to the ring half 48 clamps securly to the telescope 12 and holds the telescope 12 in a secured position. A blade is formed on the underside of the upper portion 35 and the blade 36 fits closely into the slot 37 of the lower portion of the mount 40. A hole 38 passes through the body of the lowre portion 40 and also through the forward portion of the blade 36 forming a hinge for vertical swinging of the rear of the telescope 12. The vertical swinging movement allows the rear mount 10 to engage for locking. The screw 39 passes through the bore 38 of the lower body 40 and also through the blade in a close fit, and is secured by the threaded portion of the hole 38. A locking lug 21 is also formed on the lower end of the lower body 40 and has flats formed on it's sides to pass through the slot 43. The ends of the lug 21 conforming to the shape of the ends 42 of the slot 43. When the telescope 12 is secured in the mount 11, the locking lug 21 is inserted into the mount base 41 and the telescope and mount are rotated as in FIG. 2, the locking lug 21 will engage the mating surfaces of the cavity 44 thereby locking the front mount and the telescope in a secure position. The telescope is then moved downward, swinging on the hinge formed by the front mount until the locking lug 21 of the rear mount engages the opening 25 of the base plate 24 and the rotating locking member is rotated to a locked position and the telescope is securely held at both the front and rear ends. The front base mount is secured to the firearm by the two screws 33 through holes 31 of the base 41.

Although the foregoing describes a front mount and a rear mount, it is obvious that the mounts could be reversed and the previously described front mount could be placed at the rear and the rear could be placed at the front. Likewise, the device described herein as having a hinged front mount can also be used with a rigid front mount without a hinge by using the base shown in FIG. 10 wherein the base has an opening in the side which will allow the rotating locking lug to enter the base for locking.

Although but a few of the embodiments of the invention have been shown and described, it will be apparent to those skilled in the art that various changes and modifications may be made therein without departing from the spirit of the invention or from the scope of the appended claims.

What is claimed is:

1. A telescope mount for detachably fastening a telescope to a firearm comprising:

holding means for holding a telescope in a secure position, post means extending from the underside of said holding means, locking means rotatably mounted on said post means for movement about a vertical axis between a locked position and an unlocked position respectively, base means for fixed attachment to a firearm, coupling means mounted on said base means for engagement with said locking means, said coupling means having a shape complimentary to the shape of said locking means for providing a tight slidable mating engagement when said locking means is rotated from an unlocked position to a locked position, said locking means and said coupling means urging said holding means and said base means together in a closely interconnected relationship and when said locking means is rotated from a locked position to an unlocked position, said holding means and said telescope are detachable from said base means.

2. The structure as set forth in claim 1 to include lateral adjustment means mounted on said base means for lateral movement of said coupling means.

3. The structure as set forth in claim 1 to include lever means mounted on said locking means to provide leverage for rotating said locking means from an unlocked position to a locked position and for rotating said locking means from a locked position to an unlocked position.

4. The structure as set forth in claim 1 taken in combination with a second mount said second mount being attached to a telescope and toward the opposite end of said telescope, said second mount comprising: a lower portion which is pivotally mounted on a firearm an upper portion that is adapted to hold a telescope said lower portion having a slot formed on it's upper surface and said upper portion having a blade formed on it's underside said blade conforming to said slot and mounted in said slot, pivot pin means extending through said lower portion and slot and through said blade to form a hinge for vertical arcuate movement of a telescope held by said upper portion.

5. The structure as set forth in claim 1 wherein said coupling means has an opening in it's uppermost surface to permit said locking means to engage said coupling means from a vertical direction.

6. The structure as set forth in claim 5 wherein said opening extends through the side of said coupling means to allow said locking means to engage said coupling means from the side.

7. A telescope mount for detachably fastening a telescope on a firearm comprising:

a lower portion for mounting on a firearm, an upper portion that is adapted to hold a telescope, said lower portion having a slot formed on it's upper surface, said upper portion having a blade formed on it's underside said blade conforming to said slot and mounted in said slot, pivot pin means extending through said lower portion and through said slot and through said blade therby forming a hinge for vertical arcuate movement of a telescope held by said upper portion.

8. A telescope mount for detachably fastening a telescope on a firearm comprising:

a lower portion for mounting on a firearm, an upper portion that is adapted to hold a telescope, said upper portion having slot means formed on it's underside, said lower portion having blade means formed on it's upper side, said blade means conforming to said slot means and mounted in said slot means, pivot pin means extending through said upper portion and into said blade means thereby forming a hinge for vertical arcuate movement of a telescope held by said upper portion.

9. A telescope mount for detachably fastening a telescope on a firearm comprising:

holding means for holding a telescope in a secure position, locking means rotatably mounted on said holding means, said locking means having a lug mounted thereon, said lug having flattened surfaces on opposite sides thereof, lever means mounted on said locking means providing leverage for rotation thereof, base means for fixed attachment to a firearm, coupling means mounted on said base means for engagement with said locking means, said coupling means having an elongated opening through it's outer face, said opening connecting with cavity means formed within said base means, said elongated opening and said cavity means conforming to the shape of said lug, said elongated opening allowing said lug to enter into said cavity means for rotation to a locked position and for rotation to an unlocked position for detachably fastening a telescope to a firearm.

* * * * *